United States Patent [19]

Naito

[11] 4,180,969

[45] Jan. 1, 1980

[54] ELECTRONIC TIMEPIECE WITH GLOBAL TIME ZONE DISPLAY

[75] Inventor: Okito Naito, Suwa, Japan

[73] Assignee: Kabushiki Kaisha Suwa Seikosha, Tokyo, Japan

[21] Appl. No.: 830,936

[22] Filed: Sep. 6, 1977

[30] Foreign Application Priority Data

Sep. 3, 1976 [JP] Japan ..... 51-106137

[51] Int. Cl.[2] ..... G04B 19/22; G04B 19/24

[52] U.S. Cl. ..... 58/42.5; 58/58

[58] Field of Search ..... 58/23 R, 42.5, 43, 44, 58/58, 4 A

[56] References Cited

U.S. PATENT DOCUMENTS

| | | | |
|---|---|---|---|
| 3,653,204 | 4/1972 | Miwa | 58/4 A |
| 3,922,842 | 12/1975 | Fujita | 58/58 |
| 3,940,920 | 3/1976 | Nakamura | 58/42.5 |
| 4,044,545 | 8/1977 | Shimizu | 58/42.5 |
| 4,072,005 | 2/1978 | Teshima | 58/42.5 |
| 4,133,170 | 1/1979 | Kashio | 58/4 A |

*Primary Examiner*—Stanley J. Witkowski
*Assistant Examiner*—William L. Feeney
*Attorney, Agent, or Firm*—Blum, Kaplan, Friedman, Silberman & Beran

[57] ABSTRACT

An electronic timepiece including a global time display that is adapted to display local time when the timepiece is in a local time mode and is adapted to be automatically indexed to display a time at a different time zone when the timepiece is in a global display mode is provided. A plurality of numerical display digits are provided for displaying time information and a plurality of visual indication display segments are disposed about the numerical display digits for selectively indicating a predetermined time zone corresponding to the time displayed by the numerical display digits. The mode select circuitry is provided for effecting a display of local time by the display digits and a local time zone by the visual indication display segments when the selection circuitry is disposed in a global time mode. Indexing circuitry is provided for indexing the count of the numerical display digits and for indexing the visual display segments to represent different global time zones representative of the count of the numerical display digits when the selection circuitry is disposed in a global time mode.

7 Claims, 11 Drawing Figures

| ZONE NUMBER | ZONE COUNTER | TIME DIFFERENCE | REGION |
|---|---|---|---|
| 0 | 0 0 0 0 0 | 0 | |
| 1 | 1 0 0 0 0 | 1 | HONOLULU |
| 2 | 0 1 0 0 0 | 2 | |
| 3 | 1 1 0 0 0 | 3 | LOS ANGELES |
| 4 | 0 0 1 0 0 | 4 | DENVER |
| 5 | 1 0 1 0 0 | 5 | CHICAGO |
| 6 | 0 1 1 0 0 | 6 | NEW YORK |
| 7 | 1 1 1 0 0 | 7 | SANTIAGO |
| 8 | 0 0 0 1 0 | 8 | RIO DE JANERO |
| 9 | 1 0 0 1 0 | 9 | |
| 10 | 0 1 0 1 0 | 10 | |
| 11 | 1 1 0 1 0 | 11 | GMT |
| 12 | 0 0 1 1 0 | 12 | PARIS |
| 13 | 1 0 1 1 0 | 13 | CAIRO |
| 14 | 0 1 1 1 0 | 14 | MOSCOW |
| 15 | 1 1 1 1 0 | 14.5 | |
| 16 | 0 0 0 0 1 | 15 | |
| 17 | 1 0 0 0 1 | 15.5 | |
| 18 | 0 1 0 0 1 | 16 | KARACHI |
| 19 | 1 1 0 0 1 | 16.5 | |
| 20 | 0 0 1 0 1 | 17 | DACCA |
| 21 | 1 0 1 0 1 | 17.5 | |
| 22 | 0 1 1 0 1 | 18 | BANGKOK |
| 23 | 1 1 1 0 1 | 18.5 | SINGAPORE |
| 24 | 0 0 0 1 1 | 19 | HONG KONG |
| 25 | 1 0 0 1 1 | 19.5 | X |
| 26 | 0 1 0 1 1 | 20 | TOKYO |
| 27 | 1 1 0 1 1 | 20.5 | X |
| 28 | 0 0 1 1 1 | 21 | SYDNEY |
| 29 | 1 0 1 1 1 | 21.5 | X |
| 30 | 0 1 1 1 1 | 22 | |
| 31 | 1 1 1 1 1 | 23 | WELLINGTON |

FIG. 7

ELECTRONIC TIMEPIECE WITH GLOBAL TIME ZONE DISPLAY

BACKGROUND OF THE INVENTION

This invention is directed to an electronic timepiece with a global time display, and in particular to a global time display timepiece that is selectively disposable between a local time mode, wherein the time for a predetermined local time zone is displayed, and the local time zone indicated, and a global display mode, wherein the numerical display digits display time in different global time zones and indicate the particular time zone being displayed.

Initially, electronic wristwatches capable of providing indication of the time for each of the twenty-four global time zones were mechanical or electro-mechanical hand display wristwatches. Such wristwatches were characterized by a circular scale representative of each of the global time zones with a location within each time zone being designated on the circular scale, in order to permit the wearer of the wristwatch to readily identify the particular time for that time zone. Selection of global time zone information was obtained by manually rotating the circular scale with respect to the hands display.

Although digital display global timepieces, wherein numerical display digits are provided for displaying the time in more than one global time zone have been provided, such timepieces provide less than completely satisfactory correction of the time displayed thereby. Specifically, instead of permitting time correction to be effected in the time zone that is being displayed by the timepiece, the time, at a particular reference time zone, such as the latest time zone, is selected for correction, and thereafter the difference in the time between respective time zones is added to the time at the reference time zone. Thereafter, each of the remaining counters must be adjusted to take into account the time at the referenced time zone. An apparent disadvantage of this type of arrangement is that the latest time zone will often be on a different day and can even be in a different month, year, etc., than a particular global time zone for which time correction is being sought, thereby requiring an unusually large number of carry digits having to be transferred between series connected counters to accommodate for the date, year and month changes. Accordingly, an electronic timepiece with a global digital display, that permits correction in each of the global time zones capable of being displayed, is desired.

SUMMARY OF THE INVENTION

Generally speaking, in accordance with the instant invention, an electronic timepiece with a global time zone display that is selectively disposable between a local time mode and a global time mode, is provided. The electronic timepiece includes a plurality of series-connected counters, each of the counters being adapted to produce at least one timekeeping signal representative of the count thereof. A display driving circuit is coupled to each of the series-connected counters for receiving the timekeeping signals produced thereby and producing drive signals in response thereto. A plurality of numerical display digits are coupled to the display driving circuitry for displaying time information in response to the drive signals produced thereby. A plurality of visual indication display segments are peripherally disposed about the numerical display digits and are coupled to the display driving circuitry for selectively indicating a predetermined time zone corresponding to the time displayed by the numerical display digits. The invention is particularly characterized by mode select circuitry coupled to at least one of the series-connected counters for selectively disposing the counter between a local time mode and a global time mode. Each of the counters, coupled to the mode select circuitry, is adapted to produce timekeeping signals representative of time at a local time zone when the mode select circuitry disposes same in a local time zone mode. Indexing circuitry is coupled to the same series-connected counters as the mode select circuitry for indexing the count of each of the series-connected counters that same are coupled to, to thereby index the count of the timekeeping signals produced thereby and, hence, the time displayed by the digital display digits and the time zone indicated by the visual indication display segments, when the mode select circuitry is disposed in a global time mode.

Accordingly, it is an object of the instant invention to provide an improved electronic timepiece with a global time zone digital display.

A further object of the instant invention is to provide a global timepiece that is capable of permitting correction of the time when same is disposed in any global time zone.

Still a further object of the instant invention is to provide an electronic timepiece with a global time display wherein the digital display can be automatically indexed from a predetermined time zone, to display time in other global time zones and be automatically returned to the same predetermined time.

Still another object of the instant invention is to provide an electronic timepiece with a global time zone digital display that is capable of being selectively disposed between a local time mode and a global time mode, and is capable of automatically indicating a reference time, such as Greenwich Mean Time, or the like, when operating in a local time mode.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 7 is a table illustrating the respective global time zone binary addresses utilized to select the desired global time zone to be displayed;

DETAILED DESCRIPTION OF THE PREFERRED EMBODIMENTS

Figure 1:
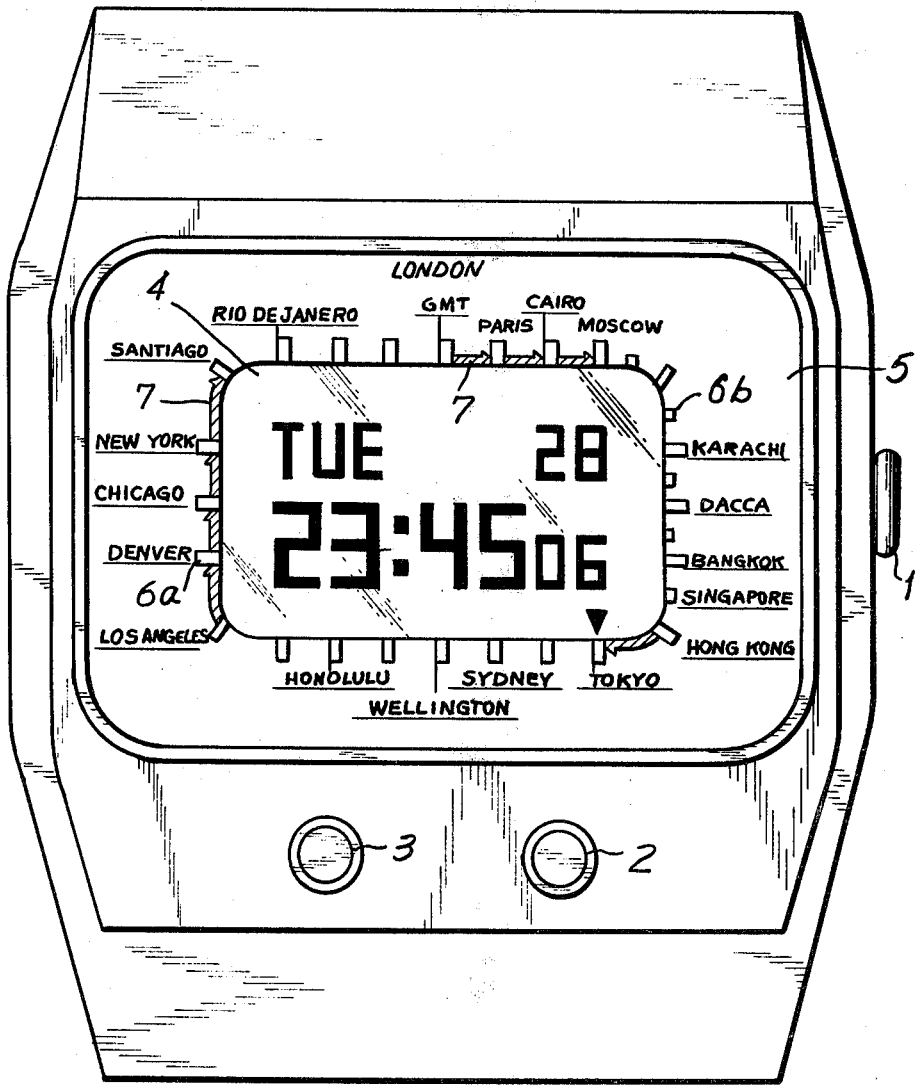
FIG. 1 is a plan view of a global electronic timepiece, and, in particular, a digital display therefor, constructed in accordance with a preferred embodiment of the instant invention.

Reference is first made to FIG. 1, wherein a liquid crystal digital display global electronic wristwatch, constructed in accordance with the instant invention, is depicted. For purposes of illustration, certain of the liquid crystal display segments, comprising the numerical digital display, day of the week display and a visual identification display segment, are illustrated in FIG. 1.

The electronic timepiece, depicted in FIG. 1, includes a manually actuatable select crown 1 that can be pushed or pulled to effect separate and distinct switching functions. When pushed, the switching crown operates as a push button and is automatically returned to its normal position. However, when the selection crown is pulled, same will remain in a pulled out position until it is manually returned to its normal position. Manually operated push button switches 2 and 3 are provided on the front of the timepiece and are automatically returned to a rest position in the usual manner, after each actuation thereof.

As illustrated in FIG. 1, the global timepiece of the instant invention is in a local time mode so that the liquid crystal display panel 4 is displaying time information for Tokyo, Japan. Specifically, the time being displayed is twenty-three hours, forty-five minutes and six seconds on Tuesday, the 28th day of the month. It is noted that, with the exception of the tens of date digits and the tens of hours digits, the remaining numerical digits for displaying minutes and hours, conforms to a conventional seven-bar numerical display liquid crystal arrangement. Since the tens of date digits does not exceed three (3), and the tens of hours digit does not exceed one (1), a conventional seven-bar numerical configuration is not required. Additionally, the colon (:), between the minutes digits and the hours digits, can be formed from liquid crystal display segment electrodes or, alternatively, can be permanently formed on the face of the digital display. In order to effect global time zone display, a plurality of visual indication display segments (solid arrow) are peripherally disposed around the numerical digital display 4, each of the respective visual display segments being representative of a predetermined global time zone. Printed on the bezel 5, adjacent to each of the further visual indication display segments, are indicia 6*a* and 6*b* pointing out the particular locality, or other designation, identifying the particular time zone to which the visual indication display segments refer.

As is diagramatically illustrated in FIG. 1, the first indicia 6*a*, formed on the bezel, represent global time zones that are integrally related to Greenwich Mean Time and are indicative of either a specific geographical location in the time zone, or other information identifying the time zone. For example, the LONDON time zone is also represented by the designation GMT, which designation stands for Greenwich Mean Time. Because Greenwich Mean Time is a reference that is compared with other time zones, the indicia representative of Greenwich Mean Time is disposed at the twelve o'clock position of the wristwatch (when reference is made to a conventional analog clock face) in order to permit the wearer to readily compare the time differences between the time displayed for a particular time zone with the Greenwich Mean Time zone.

It is noted however that there are several global time zones that are not integrally related to Greenwich Mean Time. For example, there are several time zones in Southeast Asia that, instead of being integrally related to Greenwich Mean Time, are related thereto by a time interval equal to a predetermined integral number of hours, plus thirty (30) minutes. In order to permit the wearer of the wristwatch to discriminate between the global time zones that are integrally related to Greenwich Mean Time and those which are related thereto by an integral number of hours plus thirty (30) minutes, a second plurality of indicia 6*b* have been provided between pairs of integrally related first indicia 6*a*. Additionally, a plurality of second visual indication display segments, that are of different size or color than the first visual indication display segments, can also be provided and disposed proximate to the second indicia for permitting the wearer to clearly discriminate between the time zones that are not integrally related to Greenwich Mean Time and are indicated by the second indicia. By way of example, the time difference between India (New Delhi) and Greenwich Mean Time is five and one-half hours. Accordingly, the smaller indicia 6*b* represents a time zone that is not integrally related (five and one-half hours) to Greenwich Mean Time.

A third indicia line 7 is provided on the bezel between adjacent first indicia 6*a*. For example, a third indicia 7 is disposed between the GMT designation and the position that a visual display segment, corresponding to the PARIS designation, would be positioned. The third indicia line 7 is disposed between the designation of PARIS, which represents the time displayed during most of the year, and the designation LONDON, which represents the time displayed in FIG. 1 during the summer months when daylight savings time is in effect. Because the time zone change, that results during daylight savings time, is only one hour, by providing a third indicia line, between the visual indication display segments and a time zone designation representative of the time zone adjacent to the time zone normally represented by the visual indication display segment, the digital display facilitates the reading of time in a particular time zone in the summer months when the daylight savings time is in effect, without requiring any adjustment of the numerical time display.

The global time zone digital display electronic timepiece, depicted in FIG. 1, is adapted to operate in a first local time mode wherein the time displayed is representative of a single time zone and to be changed over into a world time mode by the pushing of the select crown 1. To this end, when the timepiece is in a local time mode, the geographical location whose time is being displayed remains fixed, and, accordingly, the global timepiece operates in the same manner as a conventional timepiece.

Figure 3:
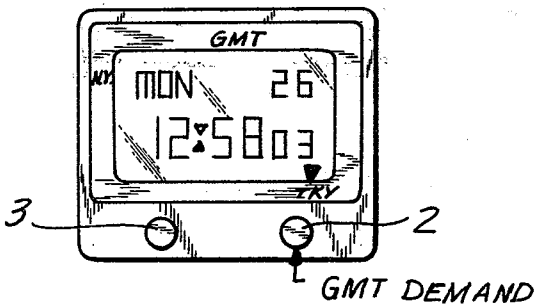

Referring to FIG. 3, the global digital display electronic timepiece of the instant invention, when same is disposed in a local time mode, is depicted. The time displayed in FIG. 3 is twelve hours, fifty-eight minutes, three seconds on Monday, the 26th day in the local time zone of Tokyo, Japan. Accordingly, when the global timepiece is in a local time mode, of the type illustrated in FIG. 3, it will operate in Tokyo, Japan as a conventional wristwatch and provide all of the timekeeping information in the usual manner. Additionally, a Greenwich Mean Time demand display feature, when the global digital display timepiece is in a local time mode, is provided. Specifically, when push button 2 is actuated, the global digital time display will display the time at Greenwich Mean Time for as long as the push button 2 is actuated. However, upon releasing the push button 2, while the timepiece remains in the local time mode, the digital display will return to displaying the time information for the local time zone. Moreover, when the Greenwich Mean Time demand feature is utilized, the visual indication display segment for Greenwich Mean Time is energized in order to indicate that the calendar display information, provided by the numerical display digits and day of the week digits, is illustrating the time for the Greenwich Mean Time global time zone.

Figure 4:
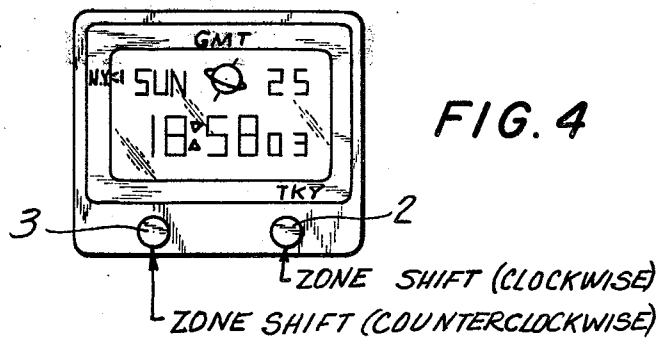
FIGS. 3 and 4 respectively illustrate the operation of the global display electronic timepiece depicted in FIG. 1.

Reference is now made to FIG. 4, wherein a plan view of the global digital display electronic timepiece, when same is disposed in a world time mode, is depicted. If the timepiece is in a local time mode, and the select crown is pushed in, the timepiece will be disposed in a world time mode whereby the time information displayed can be manually indexed to any one of the global time zones or automatically indexed to a predetermined time zone.

Specifically, a person who wishes to index the time zones can look at the different localities and/or time zone designations and determine whether the time zone to be selected will be reached faster by being indexed in a clockwise manner around the numerical display digits or, alternatively, if indexing in a counter-clockwise direction around the display digits will reach the desired time sooner. To this end, pushing of push button 2 will effect indexing by one in a clockwise direction, whereas pushing of push button 3 will effect indexing by one in a counter-clockwise direction. In order to identify that the timepiece is operating in a global time mode, the visual indication display segments are flickered, the flickering display segment being illustrated by dashed lines in FIG. 4, and, additionally, a global designation is flickered in order to demonstrate that the timepiece is in a world time mode. It is noted that the time displayed in NEW YORK is eighteen hours, fifty-eight minutes, three seconds on Sunday, the 25th day of the month. This represents the time in NEW YORK when it is twelve hours, fifty-eight minutes and three seconds on Monday, the 26th day of the month in Japan. Thus, if the timepiece is in a local time mode wherein the predetermined local time region is Tokyo, and it is desired to obtain a read-out of the time in New York, the wearer would push in the select crown 1, thereby changing over the timepiece from a local time mode to a world time mode In the case of FIG. 4, wherein the time in New York is to be illustrated, one would continue to actuate push button 3 until the display were indexed in a clockwise direction from Tokyo to New York. Moreover, once the display of time in New York is obtained, if the select crown is, once again, pushed, the timepiece is returned to a local time mode so that the time in Tokyo is once again displayed.

In order to dispose the timepiece in a correction mode, the select crown is pulled out, to thereby permit the time being displayed to be corrected. When the timepiece is disposed in a correction mode, the push buttons 2 and 3 are converted into correction control switches so that push button 2 selects the specific digit of time to be corrected, and once the specific digit to be corrected is selected, each actuation of push button 3 effects an indexing of the particular digit by a count of one. It is noted that when the timepiece is in a world time mode and the select crown 1 is pulled out, the time zone displayed by the timepiece is replaced by the local time zone so that the timepiece is disposed in a time correction state in the local time mode.

Figure 5B:
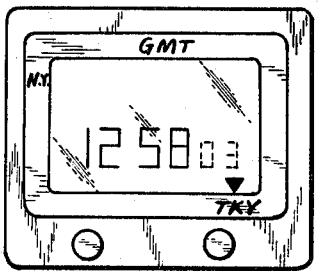
FIG. 5*b* is a plan view of the global time zone electronic timepiece depicted in FIG. 1, when same is in a correction mode.
Figure 5C:
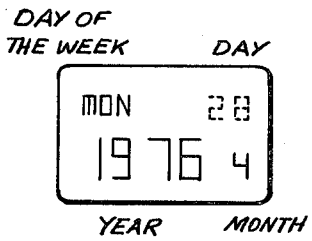
FIG. 5*c* is an illustration of the global time zone electronic timepiece, illustrated in FIG. 1, wherein same is in a calendar display mode.
Figure 5A:
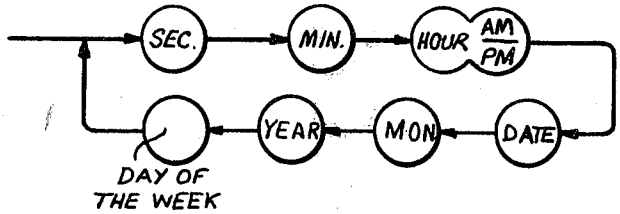
FIG. 5*a* is a diagramatic showing of the correction sequence of the electronic timepiece depicted in FIG. 1 when same is in a correction mode.

Reference is now made to FIG. 5*b*, wherein the global digital display timepiece, of the instant invention, when same s disposed in a time correction mode, is depicted. As is illustrated by the dashed seconds display, the digit of time that is selected to be corrected by the push button 2, is flickered to thereby indicate to the person making the correction which display digits are being corrected. As aforenoted, when the timepiece is in a time correction mode, each actuation of push button 2 effects a selection of different time information to be corrected. Specifically, the sequence of time information to be corrected is seconds →minutes→hour→date→month→year→day of the week→second. Moreover, when the timepiece is in a time correction mode, the date, month, year and day of the week are not displayed when the seconds, minutes and hours are corrected. Similarly, the seconds, minutes and hours are not displayed when the date, month, year and day of the week are displayed. The indexing sequence, for selecting the digits of time to be corrected, is illustrated in FIG. 5*a*, and in FIG. 5*c* the manner in which the month and year are displayed is depicted. Accordingly, when the timepiece is in a time correction mode, actuation of push button 2 will selectively index the timepiece through the sequence, illustrated in FIG. 5*a*, and thereby permit each of the types of time information displayed by the timepiece to be corrected.

Figure 6:
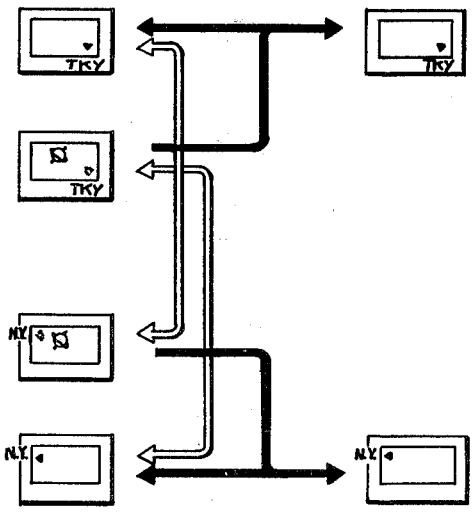
FIG. 6 is an illustrative diagram of the manner in which the global display electronic timepiece, illustrated in FIG. 1, is selectively disposed between a local time mode, a global time mode, and a correction mode.

Reference is also made to FIG. 6, which illustrates the manner in which the timepiece can be selectively disposed between three distinct modes, namely, a local time mode, a global time mode and a time correction mode. As is illustrated in FIG. 6, when the local time mode of the timepiece is Tokyo, correction is effected in Tokyo time, but the timepiece can be readily indexed through each of the global time zones to provide global time information with respect thereto. Similarly, when the local time zone of the timepiece is New York, time correction can be effected in New York, and the timepiece can be readily disposed in a world time mode to provide a display of time in Tokyo.

Figure 2:
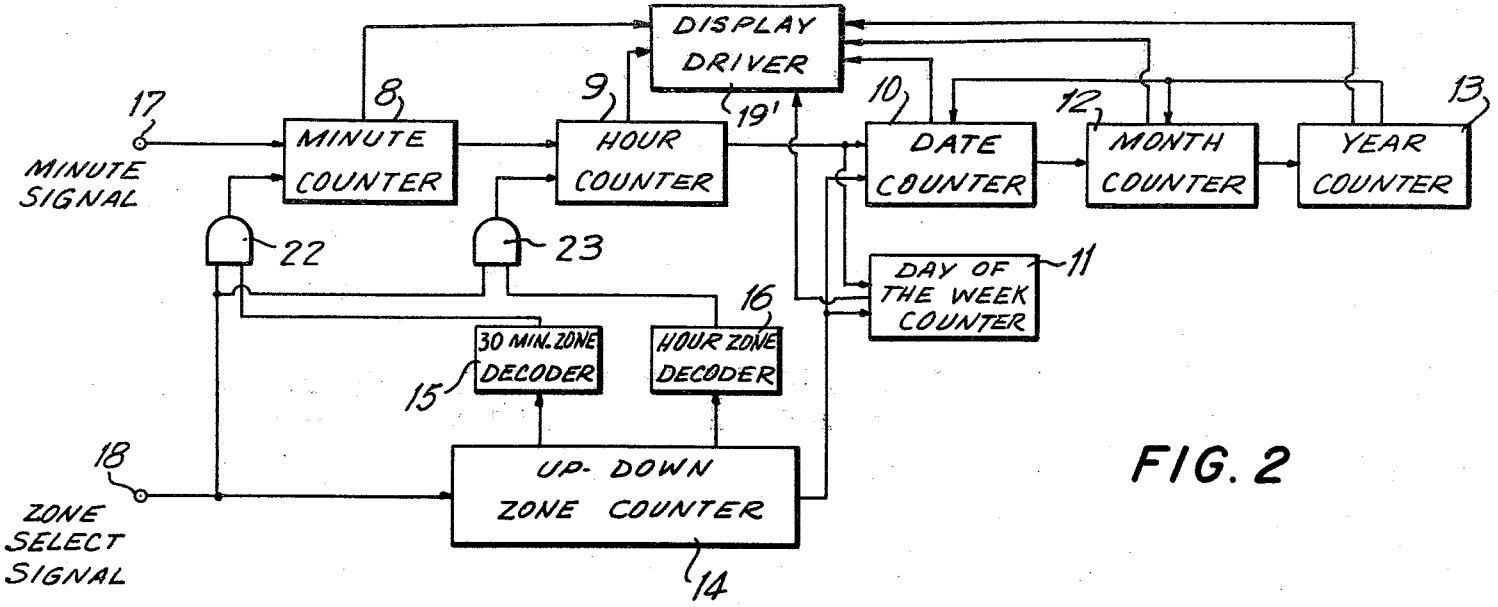
FIG. 2 is a block circuit diagram of the timekeeping circuitry for a global timepiece constructed in accordance with the preferred embodiment of the instant invention.

Reference is now made to FIG. 2, wherein the manner in which the timekeeping circuitry, of the instant invention, produces a signal to be displayed by the global time display, is depicted. A one minute signal 17, having a frequency of 1/60 Hz is applied to a minutes counter 8, which counter is series coupled to a plurality of timekeeping counters including hours counter 9, days counter 10, months counter 12 and years counter 13. Additionally, a day of the week counter 11 is coupled to the output of the hours counter 9, in order to receive the same input that is applied to the date counter 10. An UP-DOWN zone counter 14 is adapted to be indexed in response to a zone select signal applied thereto, each time that push buttons 2 and 3 are actuated, when the timepiece is in a world time mode. A thirty minute zone decoder 15 and an hours zone decoder 16 are respectively coupled to the UP-DOWN zone counter in order to respectively gate the zone select signals to the minutes counter 8 and hours counter 9. Specifically, when the UP-DOWN zone counter 14 is indexed to a thirty minute zone change, a gate signal will be applied to AND gate 22 to thereby permit a zone select signal to be applied to the minute counter to index same by a count of thirty. Alternatively, the UP-DOWN zone counter 14 is indexed to an hours zone and the hours zone decoder 16 applies a gating signal to AND gate 23 to thereby effect an indexing of the hour counter by a count of one in response to a zone select signal being produced. Additionally, the UP-DOWN zone counter 14 is coupled to the date counter 10 and day of the week counter 11 in order to effect an indexing of same when the zone counter is indexed through a day change. Finally, the month counter and year counter are coupled to the date counter in a conventional manner in order to insure that same are controlled thereby. The minutes counter 8, hours counter 9, date counter 10, month counter 12, year counter 13 and day of the week counter 11 are each coupled to a display driver circuit 19'. The display driver circuit 19' includes the decoding and multiplex driving circuitry for receiving the timekeeping signals and, in response thereto, applying the timekeeping signals to the timekeeping digital display elements and, additionally, to the visual indication display segments in order to effect an indication of the global time zone information being displayed thereby.

Reference is now made to FIG. 7, wherein a table, illustrating the manner in which the UP-DOWN zone counter 14 is indexed through binary counts representative of the numbers 0 through 31, is depicted. As is illustrated by the table in FIG. 7, the output of the UP-DOWN counter is decoded into signals corresponding to twenty-nine distinct global time zones. Accordingly, the UP-DOWN zone counter is counted UP or counted DOWN in response to actuation of the push buttons 2 and 3 when the timepiece is in a world time mode. Additionally, the hours counter and the minutes counter are also UP-DOWN counters in order to permit these counters to be indexed upward or downward in the same manner as the UP-DOWN zone counter and effect suitable changes in the time zones thereby. Moreover, by this arrangement, the count of each of the counters is always representative of the time zone information being displayed, thereby permitting the counters to be corrected when same are actually displaying time for a particular time zone. Moreover, by this arrangement, it is unnecessary to carry and borrow digits at the end of each day or month as occurs in conventional digital display global timepieces. Thus, even for thirty minute corrections, once the thirty minute zone decoder 15 effects gating of the zone select signal through AND gate 22 to the minutes counter 8, the minutes counter can be corrected for the thirty minute time zone without any unnecessary borrowing or carrying and without effecting the operation of the timepiece when same is returned to a time zone that is integrally related to Greenwich Mean Time.

Figure 8:
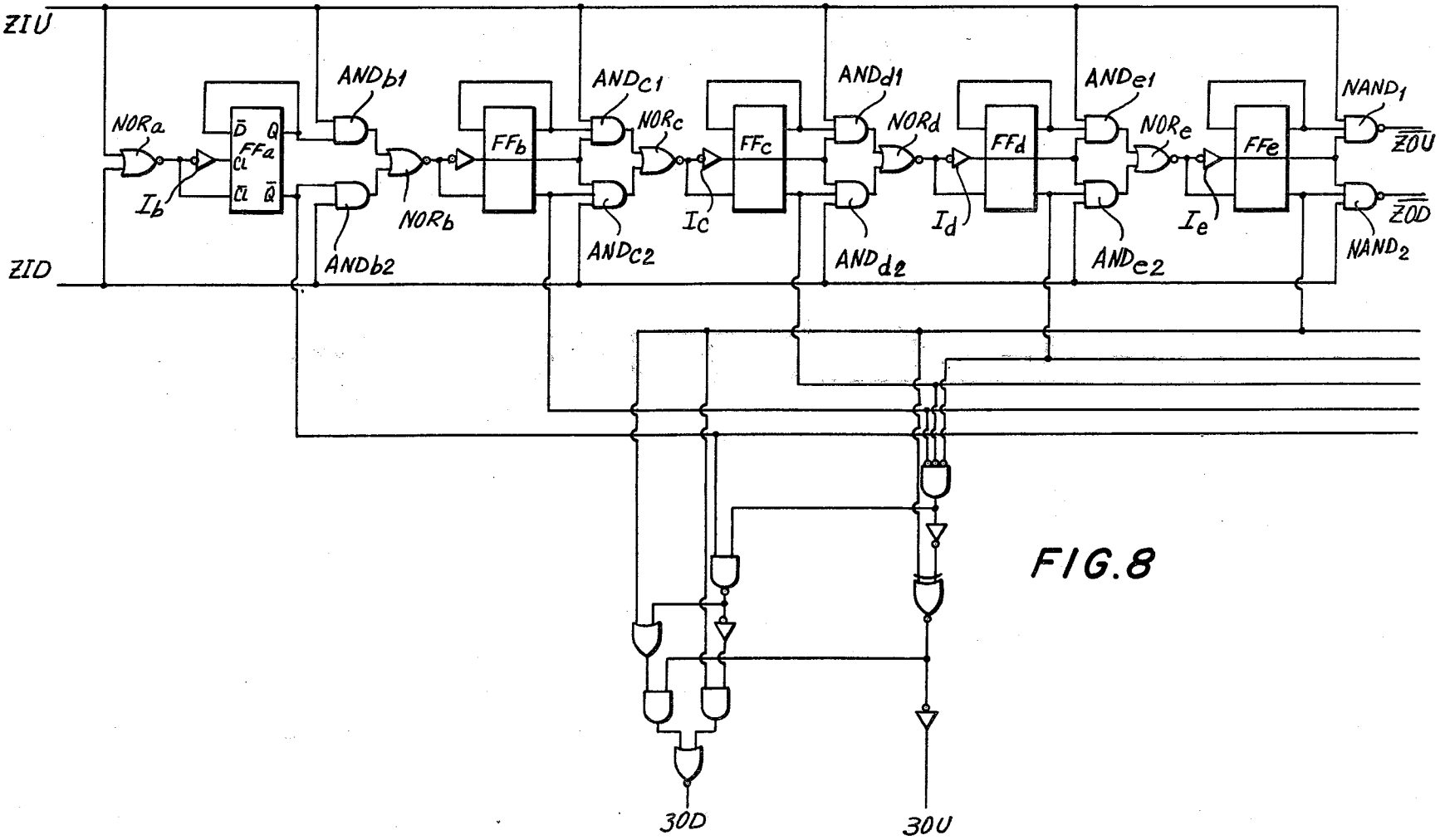
FIG. 8 is a detailed circuit diagram of an UP-DOWN zone counter constructed in accordance with the preferred embodiment of the instant invention.

Reference is now made to FIG. 8, wherein a detailed circuit diagram of the UP-DOWN zone counter 14, is presented. A zone UP input terminal ZIU and a zone DOWN input terminal ZID are selectively coupled to push buttons 2 and 3, when the timepiece is in a global time display mode in order to be controlled thereby. The zones counter is provided with outputs $\overline{ZOU}$ and $\overline{ZOD}$, which outputs produce an output when the zone counter is changed from a count of thirty-one to a count of zero. Additionally, outputs 30U and 30D are the outputs of the zone counter applied to the thirty minute decoder when a thirty minute zone is selected. It is noted that the hours and minutes counters are constructed in the same manner as the UP-DOWN counter depicted in FIG. 8. To this end, the UP-DOWN counter includes five flip-flop stages $FF_a$ through $FF_d$, with an appropriate NOR gate and inverter coupled to the inputs thereof. Additionally, flip-flops $FF_b$ through $FF_e$ have AND gate coupled intermediate each preceding flip-flop and the NOR gate, with the gating terminals of the AND gates coupled to the respective input terminals ZIU and ZID.

Figure 9:
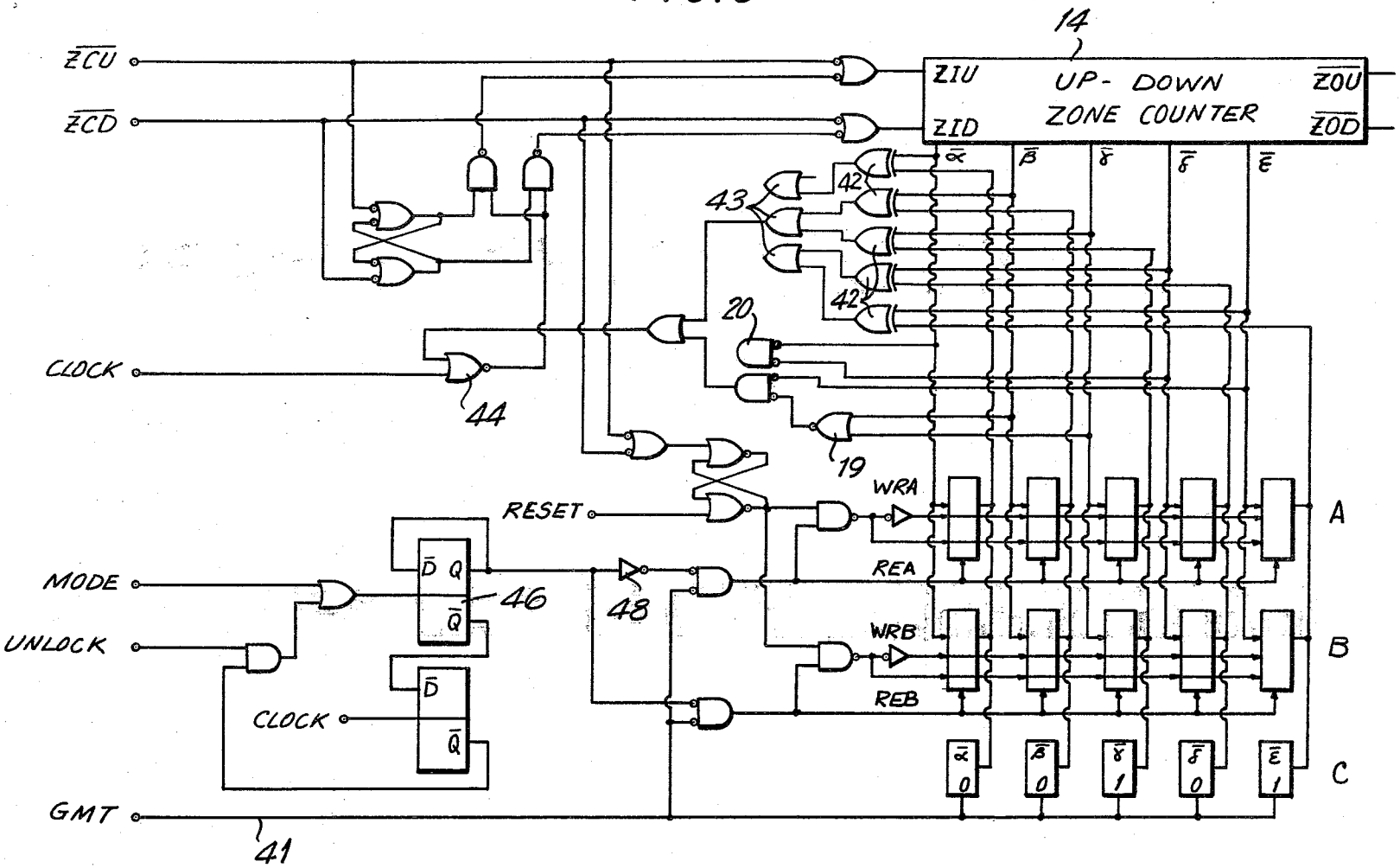
FIG. 9 is a detailed circuit diagram of the time zone counter control circuitry for controlling the operation of the UP-DOWN zone counter, depicted in FIG. 8.

Reference is now made to FIG. 9, wherein control circuitry for operating the UP-DOWN zone counter 14, depicted in FIG. 8, is illustrated. The control circuitry permits the zones to be automatically shifted when the timepiece is in a local time mode, or when the timepiece is changed over from a local time display mode to a global time display mode. To this end, registers A and B are five-bit RAMs (Random Access Memories) and register C is a ROM (Read Only Memory) for storing the address of Greenwich Mean Time (00101).

The RAM registers A and B and the ROM register C are utilized to automatically index the UP-DOWN counter when the display mode or display function of the timepiece is changed. For example, when the timepiece is disposed in a local time display mode, and push button 2 is actuated, in order to obtain a display of Greenwich Mean Time, a GMT signal is applied to terminal 41 in response to actuation of push button 2. The binary count representative of Greenwich Mean Time (00101) stored in the ROM-C is read into the comparator circuit comprised of EXCLUSIVE OR gates 42 and OR gate 43, to thereby compare the count of the UP-DOWN counter 14, represented by the signal $\overline{\alpha}, \overline{\beta}, \overline{\gamma}, \overline{\delta}, \overline{\epsilon}$. When the count of the ROM-C is not coincident with the count of the UP-DOWN zone counter 14, a gating signal is applied to NOR gate 44 to thereby permit a clock signal to be automatically applied to the UP or DOWN terminals ZIU and ZID of the zone counter 14, to thereby index same accordingly. The count of the zone counter 14 will continue to be compared with the binary count of the ROM-C, until same are coincident, after which the gating signal will no longer be applied to the NOR gate 44, and will thereby prevent the clock signal from being transmitted to the inputs of the zone counter 14. Coincidence will be reached when the numerical display digits and visual indication display segments are displaying GMT. Moreover, when the push button 2 is no longer actuated, and the timepiece is in a local time mode, flip-flop 46 will, once again, apply a local display mode signal and thereby couple RAM-A to the comparator circuit. The comparator circuit thereafter compares the predetermined local time zone, stored in the register RAM-A, and in the absence of a coincidence therebetween, permits the clock signal to again be applied to the zone counter 14, in the manner discussed above, until the UP-DOWN zone counter 14 is, once again, indexed to the predetermined local time. Accordingly, by storing a binary count, representative of local time in the register RAM-A, the predetermined local time zone to be displayed by the timepiece when same is in a local time display mode is obtained.

When the timepiece is disposed into a world time mode, a MODE signal is applied to flip-flop 46 to thereby apply a LOW level signal to the inverter 48 and, hence, decouple the RAM-A to the comparator circuitry and, instead, couple RAM-B to the comparator circuitry. At the time that the timepiece is selectively disposed from a local display mode to a world display mode, the comparator immediately begins to compare the five-bit binary number, stored in RAM-B with the count of the zone counter 14 and, hence, effects an automatic indexing of the zone counter 14 to the predetermined global time zone, stored in RAM-B. Thus, relating the operation of the control circuitry, depicted in FIG. 9, to FIGS. 3 and 4, when the timepiece is disposed in a local time mode, TOKYO, if the binary address, stored in RAM-B, is the address for NEW YORK, when the select crown is pushed in, the zone counter will be automatically indexed to the count representative of NEW YORK, and thereby permit New York time to be automatically displayed.

When the UP-DOWN zone counter is automatically indexed UP to a count of thirty-one, the signal $\overline{ZOU}$ is produced. This signal is applied to the UP input of the counter thereby rendering it necessary to effect a plus or minus one day correction. At this time, it is necessary to carry or borrow a digit in the day through year counters. Accordingly, in a preferred embodiment of the instant invention, in addition to the hours counter and minutes counter, the day counter, day of the week counter, month counter and year counter should be comprised of UP-DOWN counters of the type depicted in FIG. 8.

Whether the UP-DOWN zone counter 14 is indexed UP or DOWN, is determined by the last movement of the zone counter. If the zone counter is indexed UP, fifteen clock pulses ($32-28+11=15$) are input into the zone counter to thereby change the count of the zone counter to the count at Greenwich Mean Time (00101). Once the demand feature is no longer utilized, seventeen ($28-11=17$) clock pulses are applied to the zone counter so that same can return to the local time zone condition. Comparator gates 19 and 20, illustrated in FIG. 9, are decoders for insuring that the thirty minute regions and regions having binary addresses [(10011), (11011), (10111)] are not displayed during indexing and, instead, are jumped.

Finally, in order to read a predetermimed time zone into RAM-A or RAM-B, a reset signal can be applied to each of the stages of the register, whereafter the count of the zone counter can be read into the particular register, after which same will store the address therein. Moreover, once the address is stored in the RAM, the comparator circuitry will assure that the UP-DOWN zone counter 14 will be automatically indexed to that particular time zone when the output of the RAM is read into the comparator circuitry. Accordingly, by utilizing RAM's, automatic indexing can readily be performed, and any global time zone can be predetermined.

Accordingly, the instant invention is particularly characterized by a global timepiece that is selectively disposed between a local time mode and a world time mode, whereby the local time is not lost when the timepiece is indexed to display the time in different time zones. Moreover, the instant invention permits the timekeeping circuitry to be corrected on a real time basis, so that unnecessary borrowing and carrying by the timekeeping counters is avoided.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also understood that the following claims are intended to cover all of the generic and specific features of the invention herein described and all statements of the scope of the invention which, as a matter of language, might be said to fall therebetween.

What is claimed is:

1. In an electronic timepiece including series-connected counter means, each of said counter means being adapted to produce at least one timekeeping signal representative of the count of said counter means, display drive means for receiving each of said timekeeping signals and producing display driving signals in response thereto, a plurality of numerical display digits for receiving said display drive signals and displaying time information in response to the timekeeping signals produced by said counter means, a plurality of visual indication display segments peripherally disposed about said numerical display digits and coupled to said display drive means for selectively indicating a predetermined time zone corresponding to the time displayed by said numerical display digits, the improvement comprising manually operated mode select means coupled to at least one of said counter means for selectively disposing said counter means between a local time mode and a global time mode, each of said counter means coupled to said mode select means being adapted to produce timekeeping signals representative of a predetermined local time zone when said mode select means disposes same in a local time zone mode, and indexing means coupled to the same counter means as said mode select means, said indexing means being adapted to index the count of each of said counter means that same are coupled to and thereby index the count of said timekeeping signals produced thereby to a count representative of a different global time zone, when said mode select means is disposed in a global time mode, said indexing means including zone counter means adapted to be indexed through a plurality of counts, each said count being representative of a global time zone, storage means for storing a first count representative of said predetermined local time zone, second storage means for storing a count representative of a further global time zone, and comparator means, coupled to said mode select means for comparing the count of said second storage means with the count of said zone counter means when said timepiece is disposed from a local time mode to a global time mode, said comparator means being adapted to index the count of said zone counter means until the count of said zone counter means is coincident with the count of said second storage means.

2. An electronic timepiece as claimed in claim 1, and including manually actuatable control means coupled to said indexing means, said manually actuatable control means being adapted to selectively index said indexing means and, hence, the count of each of said counter means coupled thereto, in response to each actuation thereof, when said timepiece is in a global time display mode.

3. An electronic timepiece as claimed in claim 1, wherein said indexing means includes a third storage means for storing a count representative of a predetermined reference time zone, and actuatable control means coupled to said indexing means, said indexing means being adapted, while said control means is actuated and said mode select means is in a local time mode, to index each of said counters coupled to indexing means to said predetermined reference count stored in said third storage means, said counter coupled to said indexing means being returned to the global time zone stored in said first storage means in the absence of said control means being actuated.

4. An electronic timepiece as claimed in claim 3, wherein said reference time zone stored in said third storage means is Greenwich Mean Time.

5. An electronic timepiece as claimed in claim 1, and including correction means coupled to each of said counter means and to said mode select means, said manually operated mode select means being adapted to selectively dispose said counters into a correction mode and couple said correction means to each of said counter means to thereby effect correction of the respective counts thereof.

6. An electronic timepiece as claimed in claim 1, wherein said comparator means is adapted to compare the count stored in said first storage means with the count of said zone counter means when said mode select means is returned from a global display mode to a local display mode, said comparator means being adapted to index the count of said zone counter means to said predetermined count stored in said first storage means.

7. An electronic timepiece as claimed in claim 6, including control means for indexing the count of said zone counter means and gating means for selectively reading the count of said zone counter means into said first storage means when said timepiece is in a local display mode and for reading the count of said zone counter means into said second storage means when said timepiece is disposed in said global display mode.

* * * * *